US011134338B2

(12) United States Patent
Negishi et al.

(10) Patent No.: US 11,134,338 B2
(45) Date of Patent: Sep. 28, 2021

(54) SPEAKER, SPEAKER SYSTEM, STEREO SPEAKER SYSTEM, AND ON-VEHICLE STEREO SPEAKER SYSTEM

(71) Applicant: JVCKENWOOD Corporation, Kanagawa (JP)

(72) Inventors: Yuji Negishi, Yokohama (JP); Kazuyuki Inagaki, Yokohama (JP)

(73) Assignee: JVCKENWOOD CORPORATION, Yokohama (JP)

( * ) Notice: Subject to any disclaimer, the term of this patent is extended or adjusted under 35 U.S.C. 154(b) by 0 days.

(21) Appl. No.: 16/906,478

(22) Filed: Jun. 19, 2020

(65) Prior Publication Data

US 2020/0322717 A1 Oct. 8, 2020

Related U.S. Application Data

(63) Continuation of application No. PCT/JP2018/040083, filed on Oct. 29, 2018.

(30) Foreign Application Priority Data

Dec. 28, 2017 (JP) ..... JP2017-253663

(51) Int. Cl.
*H04R 1/34* (2006.01)
*H04R 1/02* (2006.01)

(52) U.S. Cl.
CPC ..... *H04R 1/345* (2013.01); *H04R 1/02* (2013.01); *H04R 2499/13* (2013.01)

(58) Field of Classification Search
None
See application file for complete search history.

(56) References Cited

U.S. PATENT DOCUMENTS

2011/0243362 A1 10/2011 Chick et al.
2015/0319515 A1* 11/2015 Devantier ..... H04R 1/02 381/345

FOREIGN PATENT DOCUMENTS

| | | | |
|---|---|---|---|
| JP | 55-102285 | A | 7/1980 |
| JP | 4-107995 | U | 9/1992 |
| JP | 2004-343804 | A | 12/2004 |
| JP | 2011-010056 | A | 1/2011 |
| WO | 2016123428 | A1 | 8/2016 |

OTHER PUBLICATIONS

Extended European Search Report dated Jan. 27, 2021 corresponding to application No. 18897803.5-1210.

* cited by examiner

*Primary Examiner* — Walter F Briney, III
(74) *Attorney, Agent, or Firm* — Nath, Goldberg & Meyer; Jerald L. Meyer

(57) ABSTRACT

A speaker includes a vibrating body having an annular valley portion recessed rearward and a diffuser having an annular or arcuate base part, which is positioned so that an end of the base part on the side of the vibrating body is opposed to the valley portion. The base part is provided, at the end on the side of the vibrating body, with one or more recessed parts from which distance to the vibrating body is larger than a distance of the other portion of the end to the vibrating body, each of the recessed parts being formed in any one of a sine-wave shape, a triangular-wave shape and an arc shape.

3 Claims, 10 Drawing Sheets

SPEAKER, SPEAKER SYSTEM, STEREO SPEAKER SYSTEM, AND ON-VEHICLE STEREO SPEAKER SYSTEM

CROSS-REFERENCE TO RELATED APPLICATIONS

The present application is a continuation of International Application No. PCT/JP2018/040083, filed on Oct. 29, 2018, and based upon and claims the benefit of priority from Japanese Patent Application No. 2017-253663, filed on Dec. 28, 2017, the entire contents of which are incorporated herein by reference.

TECHNICAL FIELD

The disclosure relates to a speaker, a speaker system, a stereo speaker system, and an on-vehicle stereo speaker system, and more particularly, it relates to a speaker including a diffuser, a speaker system including the speaker, a stereo speaker system including the speaker, and an on-vehicle stereo speaker system including the speaker.

BACKGROUND

A cone-shaped diaphragm equipped with a center cap having its center part projecting forward includes a recessed part where a peripheral part of the center cap and its vicinity are recessed annularly. It is known that when a speaker including such a diaphragm is operated, an output sound from the center cap interferes with an output sound from the diaphragm in a space positioned closely in front of the recessed part, so that a peak or dip may be generated in a specific frequency to disturb its sound pressure frequency characteristics, thereby causing so-called "front room effect (cavity effect)". This front room effect should be suppressed and therefore, an example of suppressing the front room effect is described in PTL 1 (JP 2004-343804 A). Meanwhile, as for a speaker including a diaphragm having the above-mentioned center cap attached thereto, a technique of arranging a diffuser for adjusting the directivity of output sound in front of the center cap is described in PTL 2 (JP 2011-010056 A).

SUMMARY

The diffuser of the speaker described in PTL 2 is not constructed to suppress the front room effect and has a limitation to adjust the directivity characteristics under condition that a disturbance by a peak or dip is produced in the sound pressure frequency characteristics due to the front room effect and therefore, it is hoped to improve the diffuser.

An object to be solved by this embodiment is to provide a speaker, a speaker system, a stereo speaker system, and an on-vehicle stereo speaker system, which are capable of suppressing the front room effect, thereby allowing the directivity characteristics adjustment to be performed favorably.

In order to solve the above-mentioned problem, a speaker according to a first aspect of an embodiment includes: a vibrating body having an annular valley portion recessed rearward; and a diffuser having an annular or arcuate base part, the diffuser being positioned so that an end of the base part on the side of the vibrating body is opposed to the valley portion. The base part is provided, at the end on the side of the vibrating body, with one or more recessed parts from which distance to the vibrating body is larger than a distance of the other portion of the end to the vibrating body, each of the recessed parts being formed in any one of a sine-wave shape, a triangular-wave shape and an arc shape.

According to the embodiment, there is obtained an effect in which it is possible to suppress the front room effect, thereby allowing the directivity characteristics adjustment to be performed favorably.

BRIEF DESCRIPTION OF TI-IE DRAWINGS

Figure 12A:
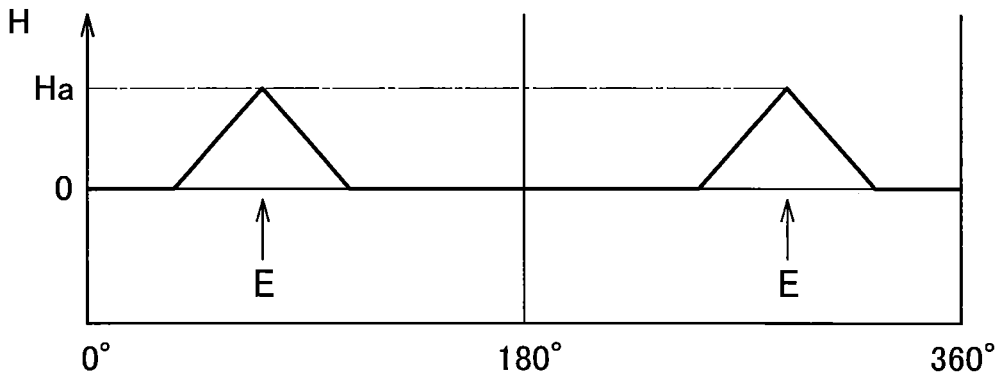
Figure 12B:
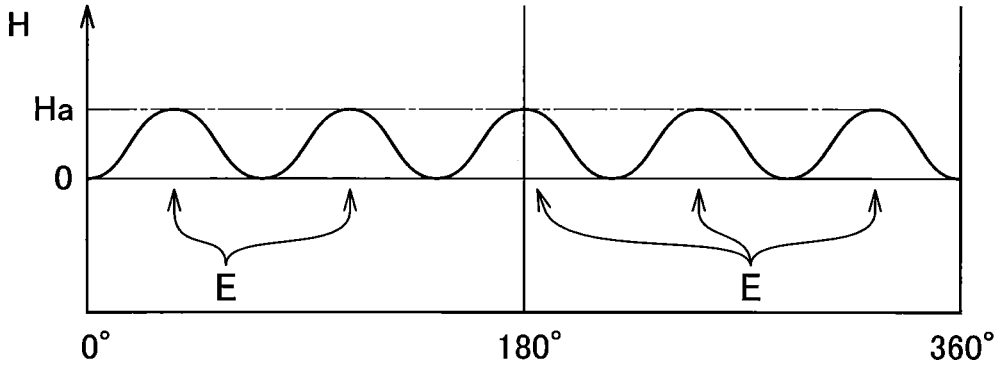
Figure 12C:
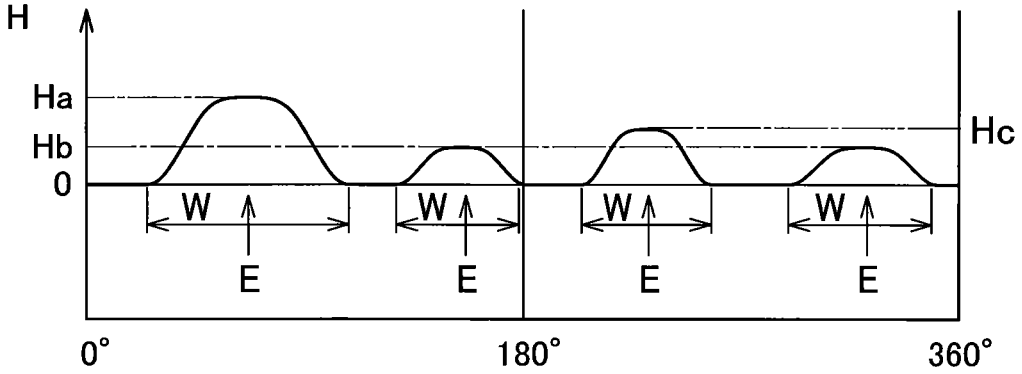

FIGS. 12A, 12B, and 12C are graphs for explaining modified examples of the recessed part E.

DETAILED DESCRIPTION

Embodiments will be described with reference to the drawings.

First Embodiment: Tweeter 51

Figure 1:
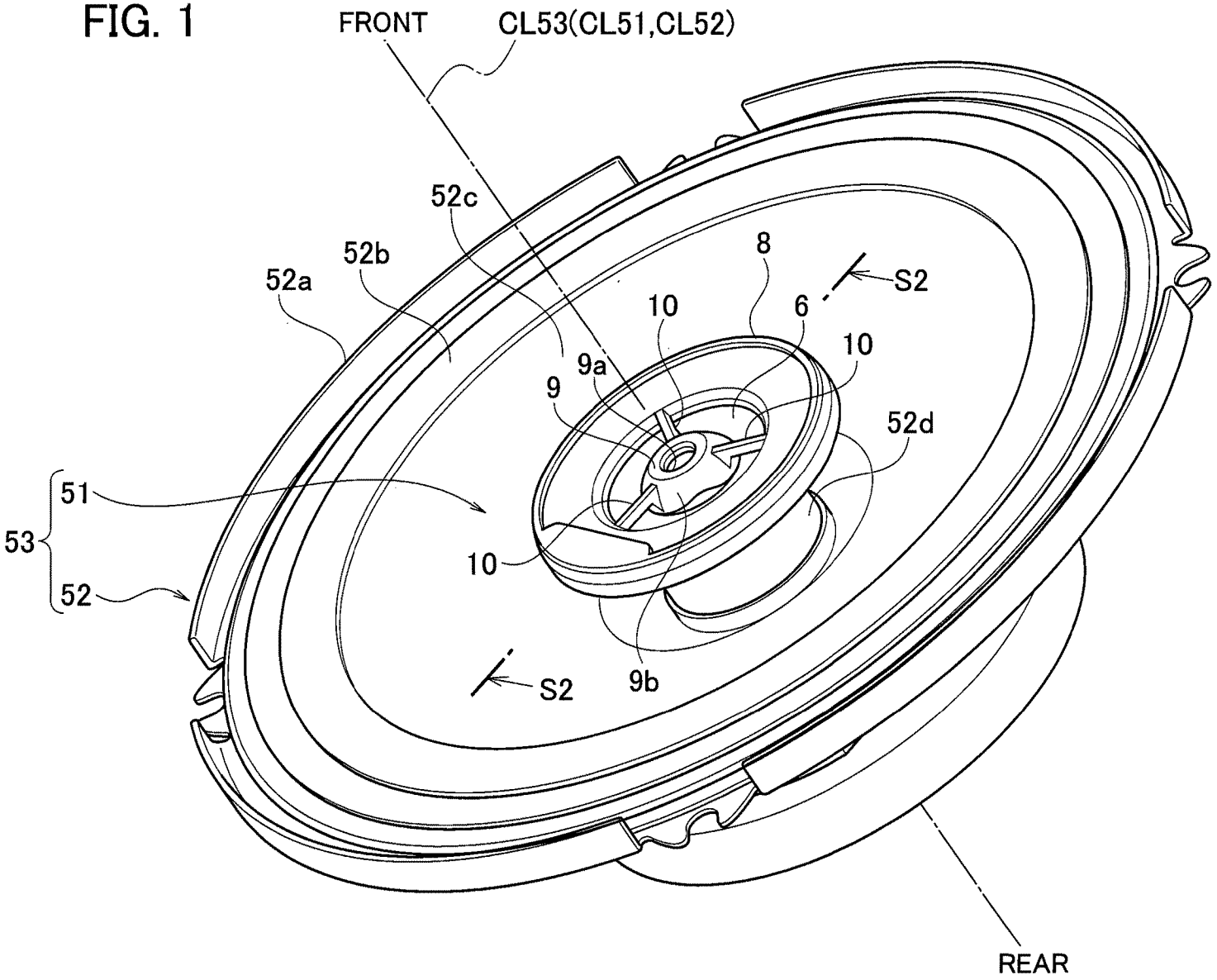
FIG. 1 is a perspective view of a coaxial speaker including a tweeter as a speaker according to a first embodiment.

FIG. 1 is a perspective view illustrating a coaxial speaker 53 equipped with a tweeter 51 as a speaker according to a first embodiment. The coaxial speaker 53 is a so-called "coaxial two-way speaker" which includes a woofer 52 and the tweeter 51 attached to the woofer 52 coaxially. The woofer 52 includes a frame 52*a* and a cone-shaped diaphragm 52*c* supported on the frame 52*a* through an edge 52*b*. It is noted here that the "cone shape" means a shape other than a truncated. cone, which allows its diameter to be continuously increased from its root side to the tip side, such as a petaloid shape of a morning glory. For convenience of the following description, the front and rear direction is defined along an axis CL53 of the coaxial speaker 53, as illustrated in FIG. 1. An axis C1,52 of the woofer 52 and an axis CL51 of the tweeter 51 coincide with the axis CL53 of the coaxial speaker 53.

Figure 2:
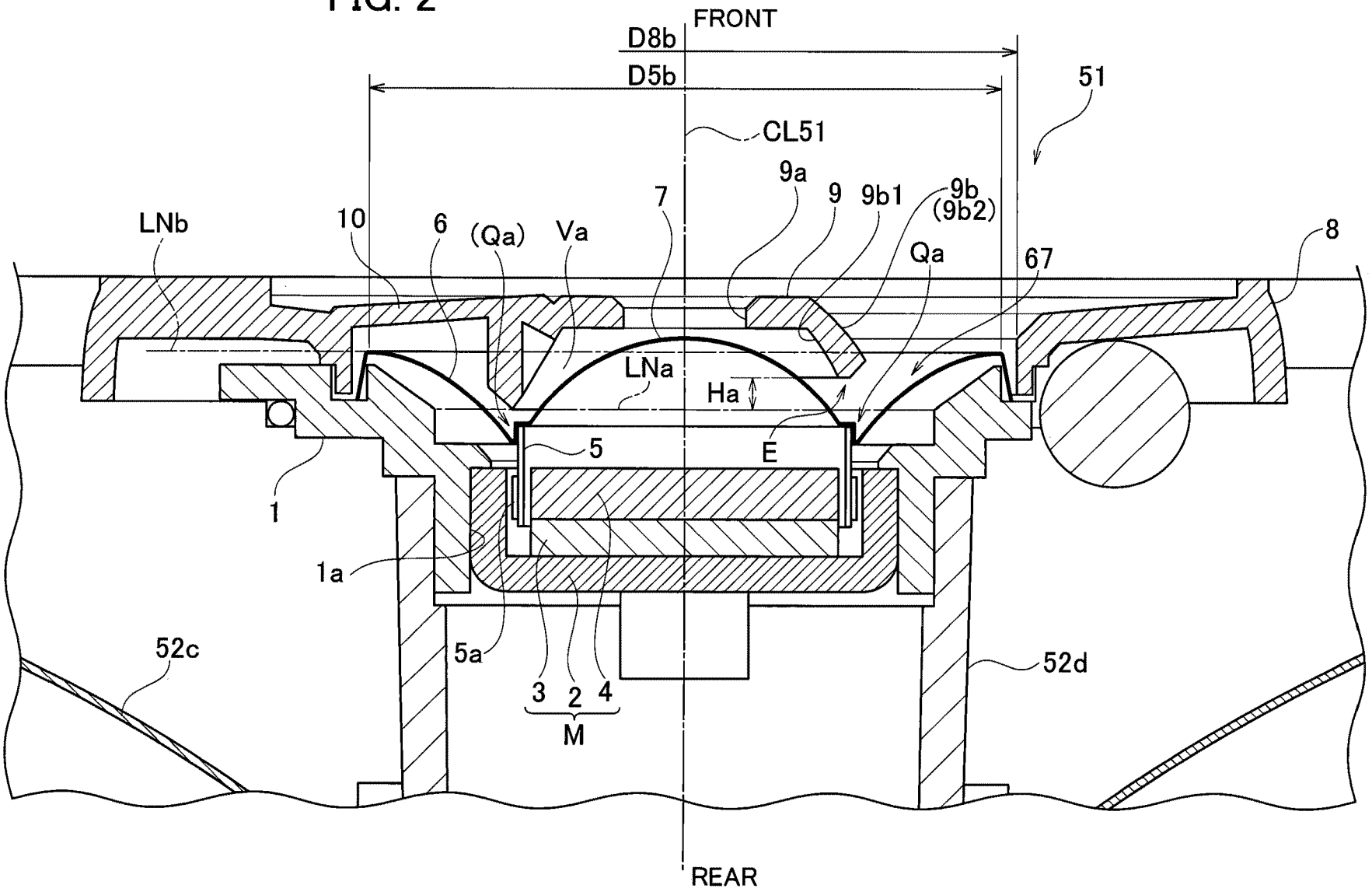
FIG. 2 is a cross sectional view taken along a line S2-S2 in FIG. 1.

FIG. 2 is a longitudinal sectional view of the tweeter 51 and also a cross sectional view taken along the line S2-S2 in FIG. 1. The tweeter 51 is a so-called "dynamic-type speaker". The tweeter 51 includes a main body frame 1 and a magnetic circuit M which includes a yoke 2, a magnet 3, and a top plate 4, The main body frame 1 is formed in a generally annular shape provided with a center hole 1*a* and is fixed to a post 52*d* protruding from the center part of the woofer 52 forwardly. The yoke 2 is formed in a round pot shape and also attached to the main body frame 1 since the circumferential part of a peripheral wall of the pot is engaged with the center hole 1*a* of the main body frame 1. The magnet 3 is formed in a disc shape and also fixed to the front surface of the bottom wall so as to form a predetermined radial gap between the magnet 3 and the peripheral wall of the yoke 2. The top plate 4 is formed in a disc shape and also attached to the front surface of the magnet 3.

The main body frame 1 supports a cone-shaped or morning-glory petaloid-shaped diaphragm 6 movably back and forth through the edge of the diaphragm 6. The diaphragm 6 is provided, at its center, with a fitting part. Further, a forward protruding center cap 7 in the form of a spherical shell is attached to the diaphragm 6 so as to close the fitting part, thereby providing a so-called "balance dome configuration". The diaphragm 6 and the center cap 7 emit sound by their vibrating. Additionally, when the center cap 7 is protruding forward, an annular valley portion Qa is defined by the center cap 7 and the diaphragm 6. In other words, the diaphragm 6 and the center cap 7 sandwich the valley portion Qa therebetween to form a vibrating body 67 for sound emission. The center cap 7 may be formed in one body with the diaphragm 6. Alternatively, the center cap 7 may be adhered to a voice coil bobbin 5 so as to keep a distance between the center cap 7 and the diaphragm 6. As for the configuration of the center cap 7, without limiting to the forward protruding configuration, it may be formed to protrude rearward alternatively. Additionally, the cylindrical voice coil bobbin 5 is attached to the diaphragm 6 so as to extend therefrom rearward while the front end of the voice coil bobbin 5 is inserted into the fitting portion of the diaphragm 6. A voice coil 5*a* is wound around the voice coil bobbin 5 on its rear end side. The voice coil bobbin 5 around which the voice coil 5*a* is wound is arranged so as to be movable back and forth in the radial gap between the magnet 3/the top plate 4 and the yoke 2. When audio signals are supplied to the voice coil, the voice coil bobbin 5 and the diaphragm 6 attached to the voice coil bobbin 5 are vibrated back and forth by electromagnetic induction with the magnetic circuit M, so that sound is outputted, In the balance-doom shaped vibrating body 67 including the diaphragm 6 and the center cap 7, an inner circumferential edge of the fitting part of the diaphragm 6, that is, an outer circumferential edge of the center cap 7 and the front end of the voice coil bobbin 5 construct the annular valley portion Qa that corresponds to the valley bottom of a portion recessed to the rear side, which may be also referred to as a "neck".

Figure 3:
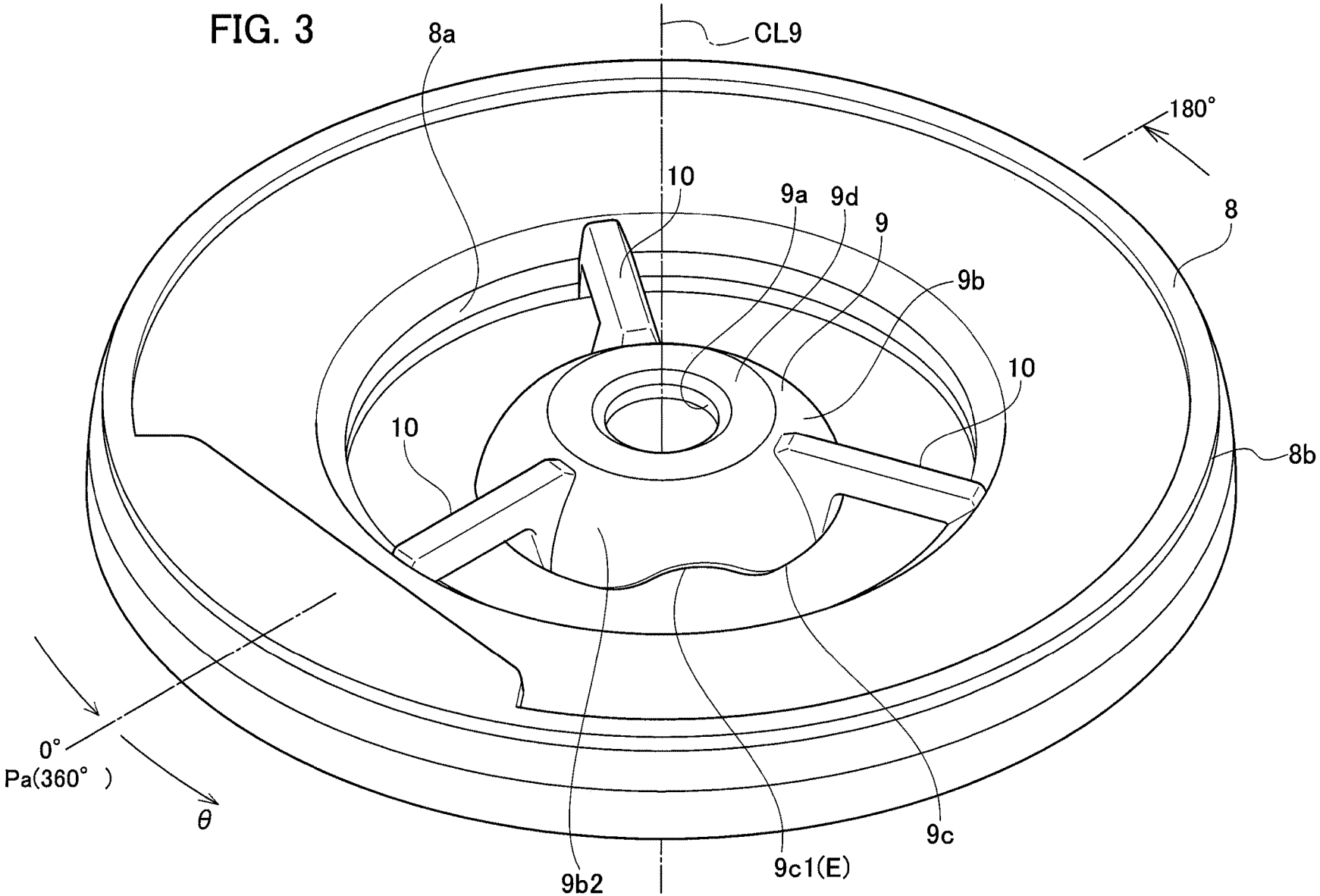
FIG. 3 is a perspective view of a front side of a diffuser base included in the tweeter.
Figure 4:
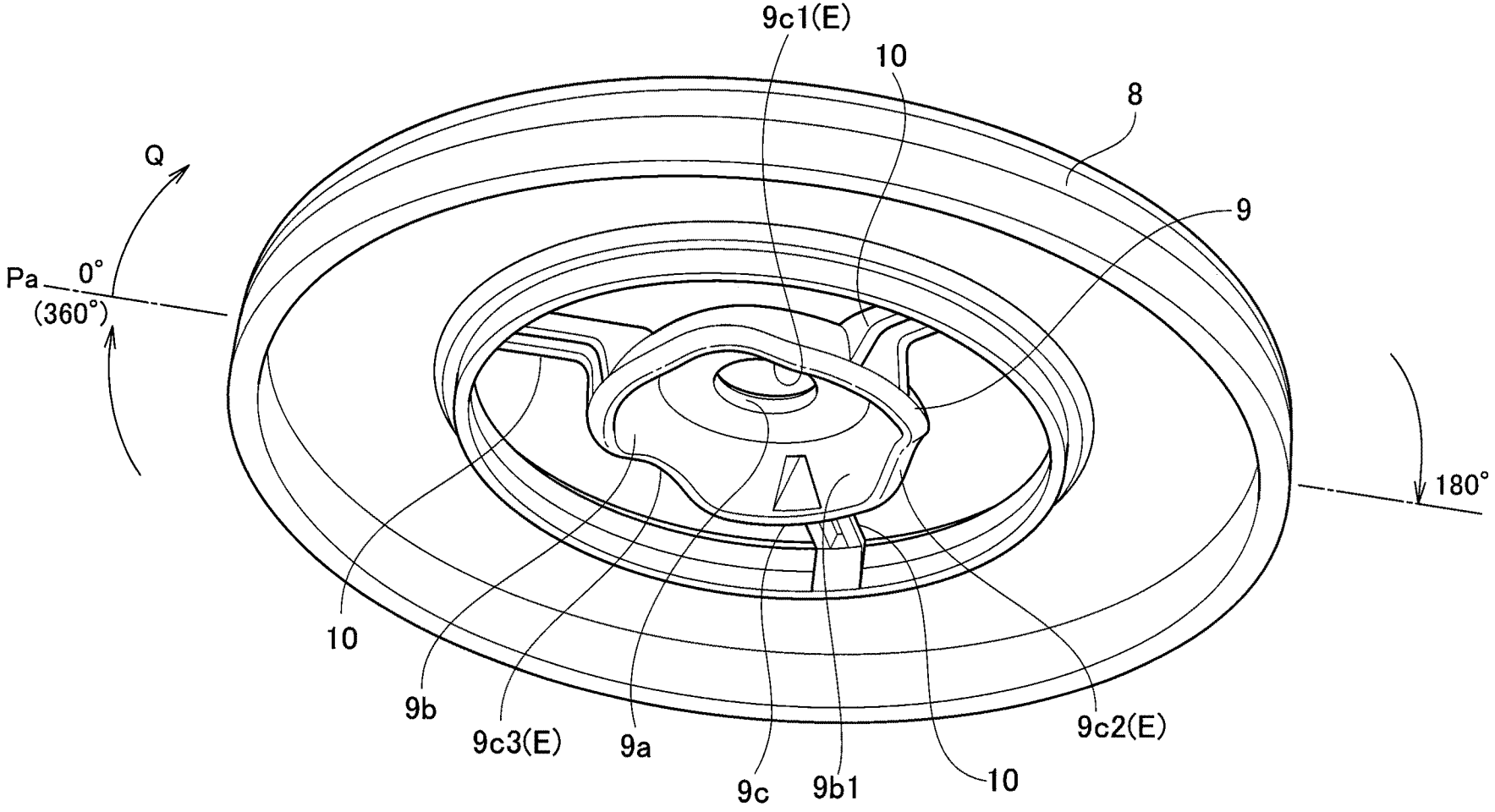
FIG. 4 is a perspective view of a rear side of the diffuser base.

The tweeter 51 includes a diffuser base 8 on the front side. In this example, the diffuser base 8 is attached to the front surface of the main body frame 1. For example, the diffuser base 8 is made of resin. FIG. 3 is a perspective view of the diffuser base 8 as viewed obliquely from the front, while FIG. 4 is a perspective view of the diffuser base 8 as viewed obliquely from the rear. As illustrated in FIGS. 2 to 4, the diffuser base 8 is in the form of a nearly annular plate and includes a sound emission hole 8*a* having an inner diameter D8*b* larger than the outer diameter D5*b* of the diaphragm 6 and a diffuser 9 disposed in the sound emission hole 8*a* and also connected and supported to an inner circumferential part of the sound emission hole 8*a* by support arms 10. In the diffuser base 8, its outer circumferential end 8*b* is folded to the rear side, thereby forming a flange. The sound emission hole 8*a* and the outer circumferential end 8*b* are connected by an inclined plane. Here, the inclined plane may be contoured with a straight line or a curvature in a longitudinal sectional shape. In this example, three support arms 10 are provided around the axis CL51 at a pitch of 120 degrees.

The diffuser 9 includes a disc-shaped front end 9*d* provided with a center hole 9*a* having an axis CL91 as the center axis, and a base part 9*b* formed so as to spread from the periphery of the front end 9*d* toward the rear side like an umbrella. The diffuser 9 may be configured by only the base part 9*b* while abolishing the front end 9*d*. Further, the front end 9*d* has not always to be shaped in the form of a disc. The base part 9*b* may be formed in a cylindrical shape having no expansion. The axis CL9 (see FIG. 3) of the center hole 9*a* coincides with the axis CL51 of the tweeter 51 under condition that the diffuser 9 is attached to the main body frame 1. It is noted that the axis CL9 of the center hole 9*a* and the axis CL51 of the tweeter 51 have not always to match each other. If they do not match, the effect of smoothing a peaks or dip in the sound pressure frequency characteristics is obtained since the distance from an arbitrary point on the axis CL51 to a ridgeline of the center hole 9*a* changes around the axis CL51, thereby causing an incoming of sounds having difference transmission routes onto the axis. The inner surface 9*b*1 of the base part 9*b* is configured to have a corner part between the disc-shaped front end 9*d* and the umbrella-shaped base part 9*b* and thus define a space between the arc-shaped center cap 7 and the inner surface 9*b*1. The inner surface 9*b*1 of the base part 9*b* may be formed as a curved surface substantially extending along the center cap 7. Alternatively, if the base part 9*b* does not have an expansion in the form of an umbrella, then the inner surface 9*b*1 becomes a surface substantially parallel to the axis CL91. The outer surface 9*b*2 is formed as a curved surface whose plate thickness in relation to the inner surface 9*b*1 is set to be almost equal. The diffuser 9 need not necessarily be configured in the form of a closed ring that is continuous around the axis CL91 and may be formed in a discontinuous substantially annular shape having a slit in a part. Alternatively, it may be formed in an arc shape even including a C-shaped configuration that is largely opened in the circumferential direction. It is noted that the following description will be predicated on the diffuser in the form of a closed ring.

The base part 9*b* is formed so that the radial position of the bottom end 9*c* as the rear side end (rear end) of the base part 9*b* is located in front of a position corresponding to the annular valley Qa. In the front and rear direction, the base part 9*b*, at least its rear end side, is located in a front space Va of the annular valley Qa. Assuming that a plane orthogonal to the axis CL51 including either nearer (lower) one of the outer periphery of the diaphragm 6 and the pinnacle of the center cap 7 is defined as a reference plane LNb, the above front space Va is defined as a space which is positioned on the front side of the diaphragm 6 and the center cap 7 and also positioned on the rear side of the reference plane LNb. In FIG. 2, the reference plane LNb is illustrated with a chain line, and a cross section of front space Va is illustrated in a region between the reference plane LNb and the vibrating body 67. Then, a part of the base part 9*b* of the diffuser 9 enters behind the reference plane LNb. That is, a part of the base part 9*b* of the diffuser 9 is positioned in the front space Va.

Further, the bottom end 9*c* as the rear side end of the base part 9*b* is configured so that the entire circumference is not contained in the same plane, but it is partially provided with a recessed part E recessed to the front side. In this example, as illustrated in FIGS. 3 and 4, the recessed part E is provided at three locations as the recessed parts 9*c*1-9*c*3.

Figure 5:
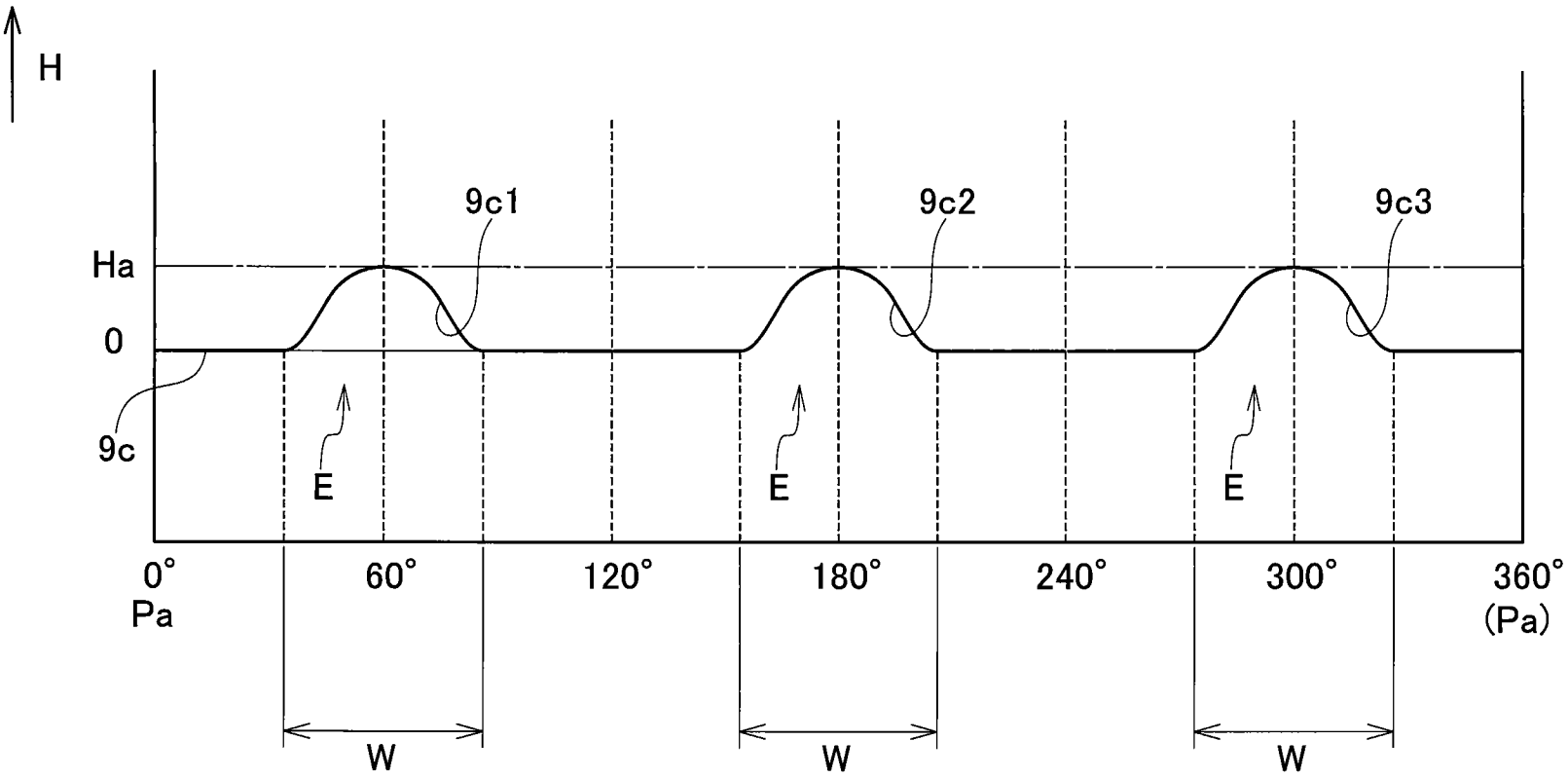
FIG. 5 is a graph for explaining the circumferential height of a diffuser bottom end of the diffuser base.

To facilitate understanding, description will be made with reference to FIG. 5. FIG. 5 is a graph which is obtained by planar-developing the respective front and rear positions of the bottom end 9*c* by 360 degrees around the circumference where the circumferential position Pa of FIG. 3 is set to 0 degree. The circumferential position Pa is a position other than the recessed part E. That is, the horizontal axis designates the circumferential position starting from the circumferential position Pa around the axis CL9, while the vertical axis designates a recession height H as the quantity of a recession to the front direction on condition that the bottom end 9*c* in the circumferential position Pa has a reference height LNa (see FIG. 2). As illustrated in FIG. 5, the recession heights H of the recessed parts 9*c*1-9*c*3 are set to Ha at the maximum. It means that the greater the recession height H on the vertical axis gets, the stronger the degree of recession gets. If the recession height H exceeds a width of the base part 9*b* in the axial direction, the base part 9*b* is divided to form a slit in between. When there are provided a plurality of slits formed by the recessed parts E, support arms 10 are arranged so as to support a plurality of base parts 9*b* divided by the slits. Further, in the recesses part E. its circumferential distance at which the recession height H has a positive value is defined as a "recession width W".

In the tweeter 51, the diffuser 9 is arranged so that the bottom end 9*c* enters the front space Va and also approaches the annular valley Qa. Thus, the base part 9*b* of the diffuser 9 functions as a separation wall that divides the front space Va into a space portion on the side of the center cap 7 and a space portion on the side of the cone part of the diaphragm 6. Therefore, since the interference between the output sound from the center cap 7 and the output sound from the cone-shaped part of the diaphragm 6 is suppressed, the occurrence of a peak or dip at a specific frequency is alleviated to reduce the possibility of a disturbance in the sound pressure frequency characteristics of the output sound. That is, the front room effect is restrained.

However, in case of providing no recessed part F, the diffuser 9 also operates as an acoustic tube and has a single resonance frequency since the front and rear directional height of the base part 9*b* is uniform. For this reason, the output sound becomes an output sound where a specific frequency region is emphasized, so that a peak is generated to cause the frequency characteristics to be disturbed. Therefore, by forming one or more recessed parts E in the diffuser 9, the resonance frequency due to the front and rear directional height of the cylindrical base part 9*b* and its diameter is dispersed to allow an occurrence of a peak of the output sound to be suppressed. When it is provided with a plurality of recessed parts F, the resonance frequency of the cylindrical base part 9*b* is dispersed to improve the directivity characteristics.

If the recessed part F has a rectangular shape, then the height of the base part 9*b* includes two difference heights by the recessed part F and other portions than the recessed part E. Thus, there are only two resonance frequencies, so that the frequency characteristics begin to have two peaks. In this view, it is preferable that the recessed part F is formed in a shape to disperse the resonance frequency furthermore, for example, a sine-wave shape, a triangular-wave shape, an arc shape, or the like. Further, it is more preferable that portions other than the recessed part F are not uniform in the height direction. However, in the sound pressure frequency characteristics of the tweeter 51, when the frequency of a peak or dip in question is related to these two resonance frequencies, this preferable matter shall not apply, and it may be preferable that the recessed part F is formed in a rectangular shape. The positioning of the recessed part F is not limited to the rear end of the diffuser 9 but may be its front end. Then, similarly to the case of arranging it at the rear end, it is possible to disperse the resonance frequency due to the acoustic tube effect and additionally, the effect as a defense wall for preventing the interference between the output sound of the center cap 7 and the output sound from the diaphragm 6 can be further enhanced since the distance in relation to the valley Qa is shortened.

Further, the degree of proximity between the diffuser 9 and the annular portion Qa is established so that the front and rear directional distance between a portion of the bottom end 9*c* with no recessed part E and the annular valley portion Qa has a minimum value in a range where the diffuser 9 would not interfere with the amplitude of the diaphragm even if an audio signal causing a maximum amplitude is inputted to the tweeter 51. Consequently, the function of the base part 9*b* as a separation wall is maximized, thereby allowing the front room effect to be further suppressed.

In this way, since the tweeter 51 includes the diffuser 9, the interference between the output sound from the center cap 7 and the output sound from the cone-shaped part of the diaphragm 6 is suppressed appropriately. By this interference suppression, energy loss due to the cancellation of output sounds each having a different angle from the direction of the sound emission axis is reduced, so that the sound pressure of the output sound is increased omnidirectionally, and the directivity characteristics of the output sound is widened. More specifically, the directivity is expanded since the sound pressure is enhanced not only in a plane perpendicular to the axis CL51 but also in the range of a solid angle existing in a direction extending from the axis CL51 toward the recessed part E.

Figure 6:
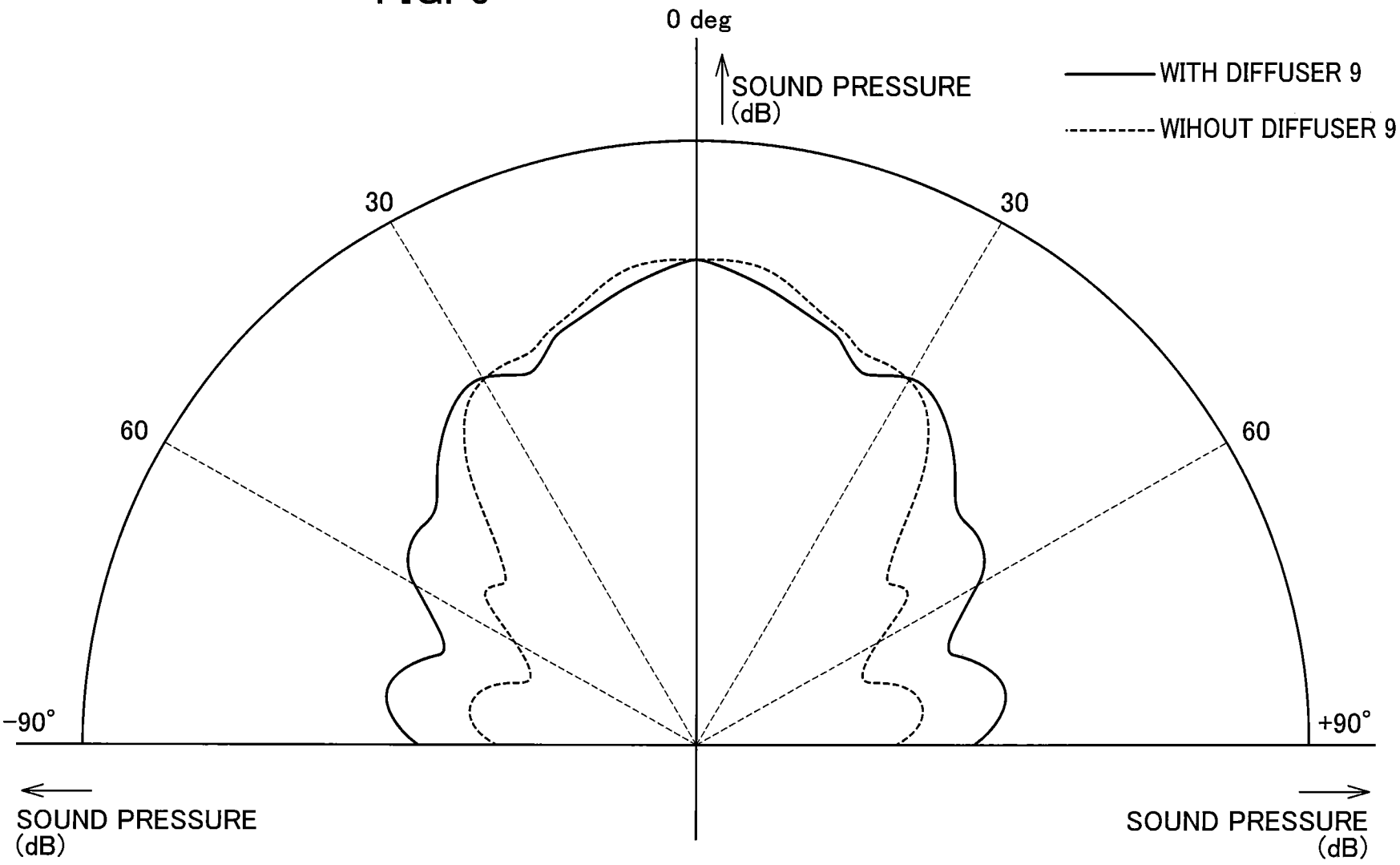
FIG. 6 is a graph for explaining a difference in the directivity characteristics depending on the presence or absence of a diffuser.

FIG. 6 is a graph illustrating the difference in the directivity characteristics depending on the presence or absence of the diffuser 9, for example, the directivity characteristics at the frequency of 14.5 kHz when the outer circumference of the diaphragm 6 is about 25 mm. In FIG. 6, a solid line indicates the directivity characteristics of the tweeter 51, that is, the directivity characteristics in case of including the diffuser 9, and a broken line indicates the directivity characteristics of the speaker without the diffuser 9. The front of the axis CL51 corresponding to the front face is set to 0 degree.

As illustrated in FIG. 6, the directivity characteristics are broadened by attaching the diffuser 9, and the directivity characteristics are remarkably improved particularly in a range of an angle wider than 40 degrees. This result is obtained between 14 kHz and 20 kHz, with a similar tendency.

Here, between an angle range where the recessed part E near the diffuser 9 is arranged and an angle range where it is not arranged, there is a difference in the interference state between the sound from the center cap 7 and the sound from the cone-shaped diaphragm 6, so that the interference state changes around the axis CL9. Thus, since the diffuser 9 includes the recessed part E at the bottom end 9*c*, it is possible to adjust the degree of an interference of the sound reaching the axis CL9 of the sound emitted from the tweeter 51. Consequently, the directivity characteristics of the output sound of the tweeter 51 can be adjusted depending on the position of the recessed part E, the number of the recessed parts E and the shape of the recessed part E Further, it is possible to suppress a peak or dip of the sound pressure frequency characteristics on the axis CL51 of the tweeter 51.

As the distance from an optional point on the axis CL51 to the ridgeline of the center hole 9*a* varies around the axis CL51, there is an arrival of sounds having different routes onto the axis, so that an effect of smoothing a peak or dip of the sound pressure frequency characteristics is obtained.

Figure 7:
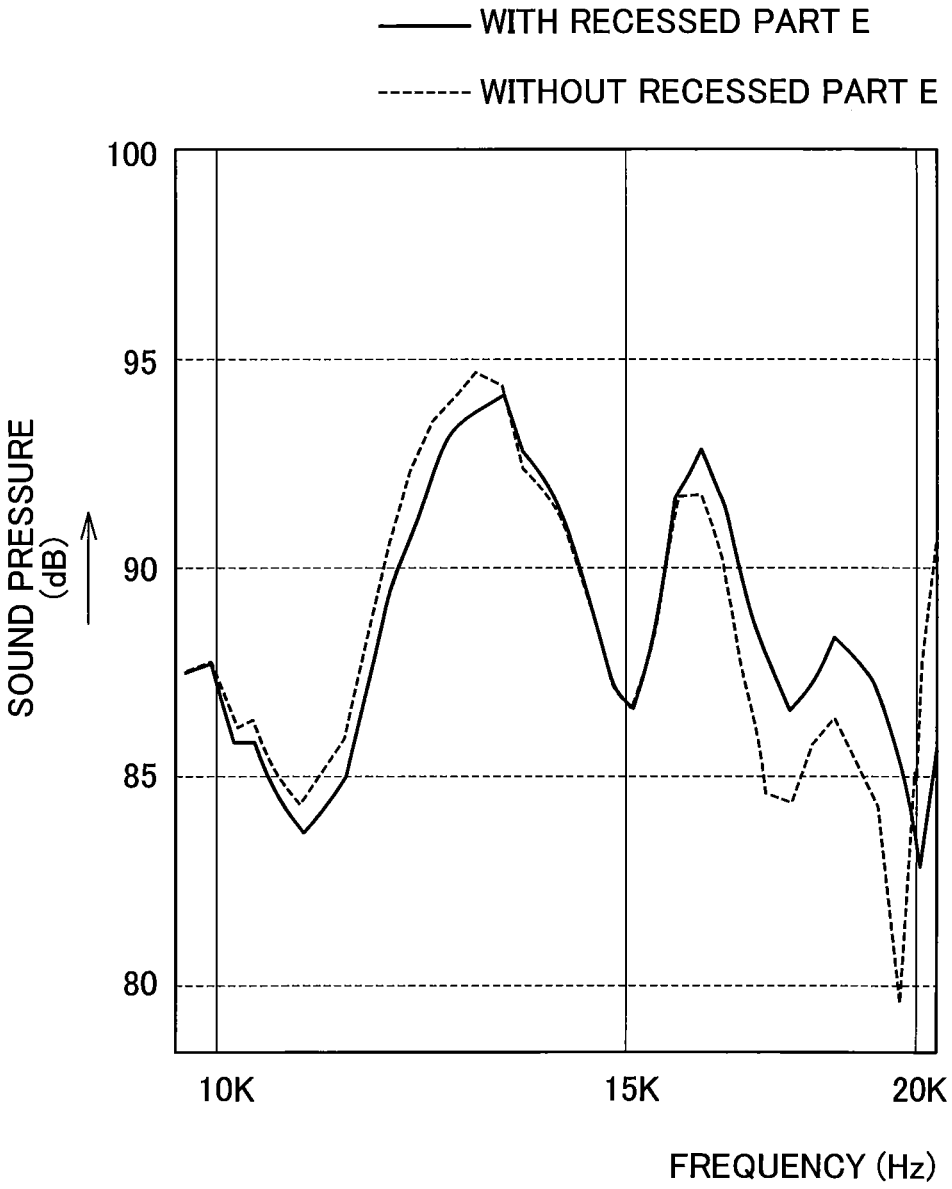
FIG. 7 is a graph for explaining a difference in the sound pressure frequency characteristics depending on the presence or absence of a recessed part.

FIG. 7 illustrates the sound pressure frequency characteristics of 10 kHz-20 kHz in front of the axis CL53 depending on the presence/absence of the recessed part E. A solid line indicates the characteristics of the tweeter 51 with the recessed part E, while a broken line indicates the characteristics under condition that the diffuser 9 of the tweeter 51 is replaced with a diffuser having no recessed part E in the shape of the base part 9*b*.

As illustrated in FIG. 7, by providing the recessed part E, it is possible to improve the sound pressure in the high frequency range of 16 kHz or more particularly. This is because the base part 9*b* of the diffuser 9 operates to reduce the interference between the sound emitted from the center cap 7 and the sound emitted from the diaphragm 6 in the vicinity of the diffuser 9, thereby suppressing the front room effect and thus increasing the sound pressure in the high frequency range from the center cap 7 with the change of arrival sound onto the axis CL53 owing to the provision of the recessed part E.

Second Embodiment: Speaker System 61

In case of listening to an output sound in front (on the front) side of a speaker system where a speaker is attached to an enclosure, generally, it is known that if the directivity characteristics of a high frequency range exhibits a broader directivity on the upper side (parietal side), the listening sound field spreads upward and especially, it becomes favorable for listening to music. From this reason, it is preferable to adopt a speaker having the diffuser 9 in a speaker system and thus attach the speaker to an enclosure such that the recessed part E is arranged on the upper side (top side) in a use state.

Figure 8:
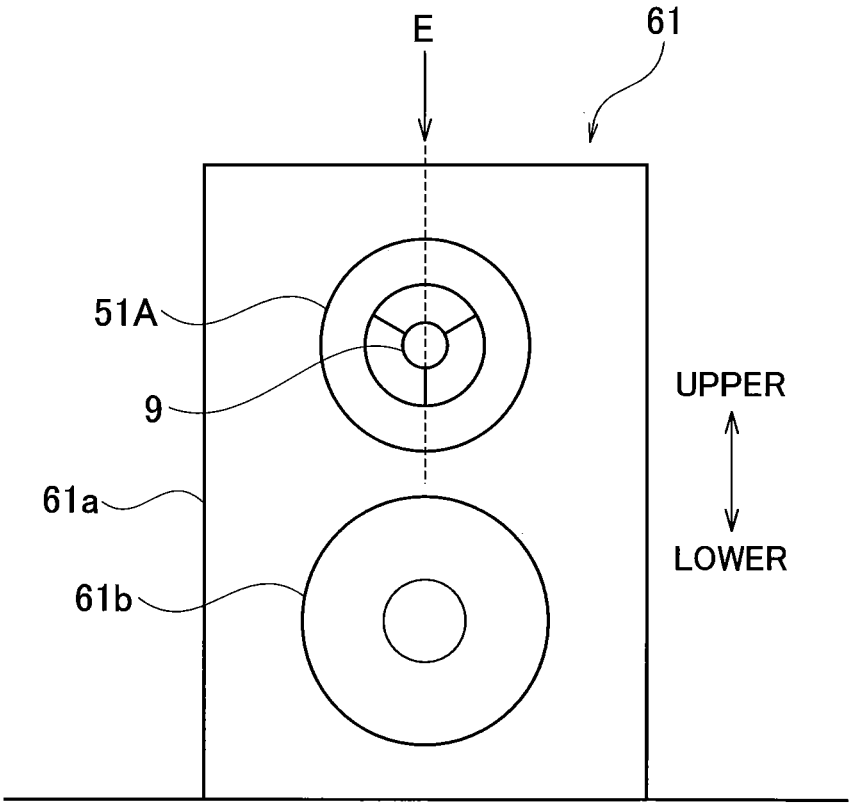
FIG. 8 is a front view illustrating a speaker system according to a second embodiment.

FIG. 8 is a front view (front side view) illustrating, as one example, a speaker system 61 according to a second embodiment. The speaker system 61 is a so-called "two-way speaker" Which includes an enclosure 61*a* as an acoustic box, and a woofer 61*b* and a tweeter 51A which are attached to the enclosure 61*a*. The tweeter 51A has a structure similar to the tweeter 51 according to the first embodiment and is attached to the enclosure 61*a* so that one of the recessed parts E of the diffuser 9 faces upward (illustrated with an arrow) in a usage posture.

The speaker system 61 has the directivity characteristics that the upper side is rich since the sound pressure in the upward direction is enhanced at least in the high frequency range of the output sound. Thus, a listener who listens to the output sound in front (on the front) of the speaker system is capable of feeling a good sound field that is spatially spread since a clear sound image is localized upward.

Third Embodiment: Stereo Speaker System 62

Figure 9:
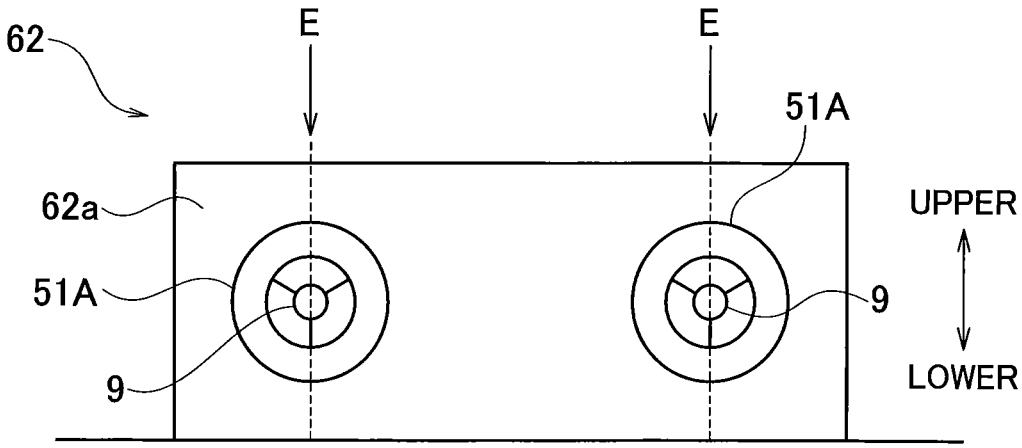
FIG. 9 is a front view illustrating a stereo speaker system according to a third embodiment.

For reproducing stereo sound, a stereo speaker system is provided by a pair of speaker systems 61 according to the second embodiment. Alternatively, a stereo speaker system may be provided by incorporating a pair of speakers into a single enclosure. FIG. 9 is a front view illustrating a stereo speaker system 62 according to a third embodiment as an example. The stereo speaker system 62 includes an enclosure 62*a* as an acoustic box and a pair of left and right speakers 51A attached to the enclosure 62*a*. Each of the speakers 51A has the same structure as the tweeter 51 or the coaxial speaker 53 according to the first embodiment. The mounting posture of each speaker 51A with respect to the enclosure 62*a* is determined such that one of the recessed parts E of the diffuser 9 is located above (illustrated with an arrow) in the usage posture of the stereo speaker system 62. in the stereo speaker system 62 according to the third embodiment, a listener is capable of feeling a stereo sound field having a three-dimensional extent, which is caused since the sound pressure in the high frequency band is enhanced on the upper side,

Fourth Embodiment: On-Vehicle Stereo Speaker System 51BS

Figure 10:
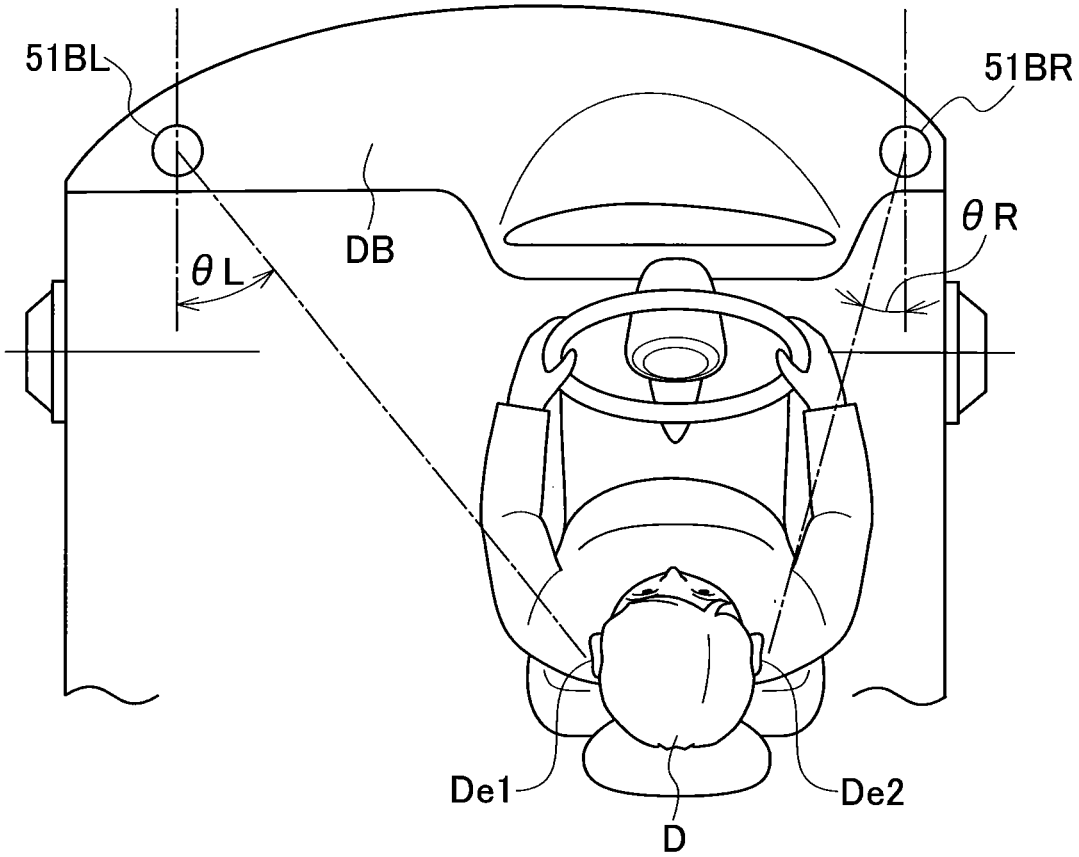
FIG. 10 is a schematic top view illustrating the vicinity of a driver's seat of an automobile.
Figure 11:
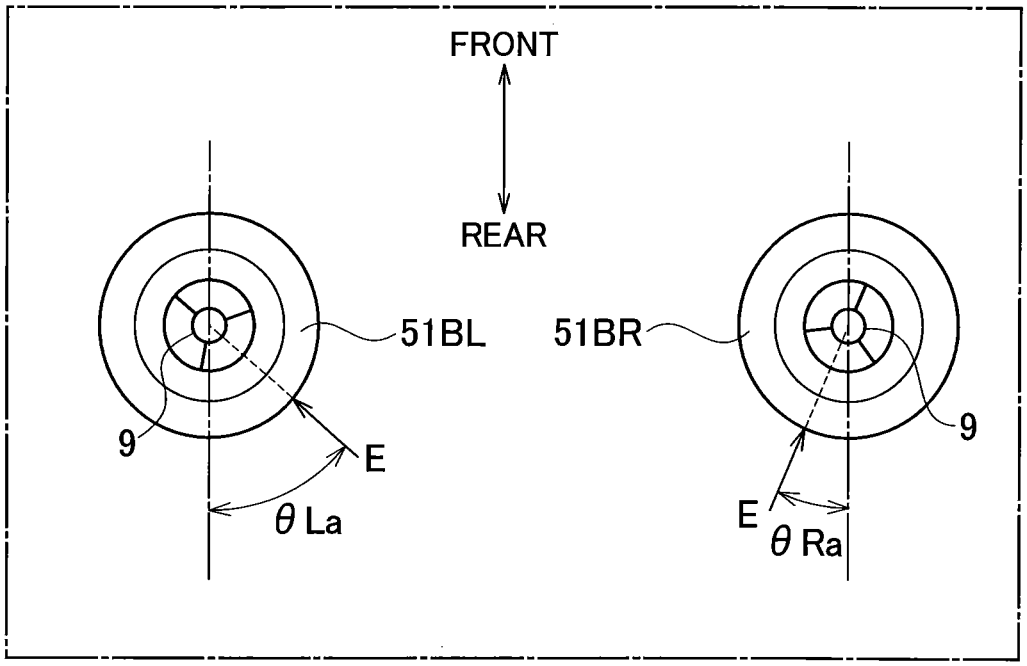
FIG. 11 is a schematic front view illustrating an on-vehicle stereo speaker system according to a fourth embodiment.

The stereo speaker system, which includes a set of speakers whose directivity characteristics are adjusted according to the formation position of the recessed parts E, is also useful for on-vehicle use. This matter will be described with reference to FIGS. 10 and 11. FIG. 10 is a schematic top view illustrating the vicinity of a driver's seat of an automobile. FIG. 11 is a view for explaining an on-vehicle stereo speaker system 51BS according to a fourth embodiment.

The on-vehicle stereo speaker system 51BS according to the fourth embodiment is configured as a pair consisting of a left speaker 51BL and a right speaker 51BR. The left speaker 51BL and the right speaker 51BR have structures each similar to the tweeter 51 according to the first embodiment. The left speaker 51BL and the right speaker 51BR may construct a separate speaker system where they are combined with woofers, respectively. The loudspeaker 51BL and the loudspeaker 51BR differ from each other only in the circumferential position of the recessed part E of the diffuser 9, and they are of the same structure in other portions. One example of the installation mode of the speakers 51BL and 51BR that allows a driver D to obtain an effect of expanding the directivity brought by the recessed part E is as follows. Of course, the installation mode is not limited to the following example. Supposing that: a driver's body axis (parallel to the vertical axis of the vehicle) is represented by an A-axis; an axis perpendicular to the A-axis, which passes through a height of ears of the driver D, is represented by a B-axis; and an axis perpendicular to the B-axis is represented by a C-axis, sound emission axes of the speakers 51BL, 51BR are set to the C-axis in order to direct the recessed part E of the speaker 51BL or 51BR to the ear of the driver D in the vehicle cabin. For example, when the speaker 51BL or the speaker 51BR is arranged vertically upward on a dashboard of the vehicle, the sound emission direction is parallel to the A-axis. Here, if the B-axis perpendicular to the A-axis is the front and rear direction of the vehicle, the C-axis perpendicular to the B-axis coincides with the sound emission axis as the vertical axis of the vehicle. In this relationship, by directing the recessed part E of the speaker 51BL or 51BR to the ear of the driver D, the effect of expanding the directivity can be obtained. As described above, since the recessed part E serves to spread the directivity in a solid angle in the direction of the recessed part E, it is possible to feel spreading of the sound image even when the height of the speaker 51BL or 51BR is different from the height of the driver D's ear. As illustrated in FIGS. 10 and 11, in the vehicle, the left speaker 51BL mounted upward on a mounted member on the left side of the driver D (on the left side of a dashboard DB in this example) has the recessed part E positioned at an angle θLa corresponding to an angle θL at which the output sound goes toward the left ear De1 of the driver D so that the sound pressure in the high frequency band is enhanced in the direction of the angle θLa. On the other hand, the right speaker 51BR mounted upward on a mounted member on the right side of the driver D (on the right side of the dashboard DB in this example) has the recessed part E positioned at an angle θRa corresponding to an angle θR at which the output sound goes toward the right ear De2 of the driver D so that the sound pressure in the high frequency band is enhanced in the direction of the angle θRa. In case of a right-hand drive vehicle, the angles θL, θLa get smaller than the angles θR, θRa, respectively. The opposite is true for a left-hand drive vehicle.

Then, when viewing the left speaker 51BL from above, the recessed part E is arranged at a position deviated from the rearward in the installation posture by the angle θLa in the counterclockwise direction. Meanwhile, when viewing the right speaker 51BR from above, the recessed part E is arranged at a position deviated from the rearward in the installation posture by the angle θRa in the clockwise direction. As a result, from the left and right speakers 51BL, 51BR, the sounds whose output sound pressures in the high frequency band are mainly adjusted by the recessed parts E are output so as to aim at the left ear De1 and the right ear De2 of the driver D. respectively. Therefore, the driver D is capable of listening to the sound of a good three-dimensional sound image in which the high frequency band is balanced on the left and right, despite the driver D is sitting at a position deviated horizontally. Separately from the recessed part E facing the user, for example, in case that the diffuser 9 includes three recessed parts E as in the first embodiment, it is possible to allow a user to feel the output sound with a sense of depth by the sounds emitted from the other recessed parts E.

For the mounted member for the speaker 51BL, 51BR in the vehicle, there are, besides the dashboard DB, a door, a window pillar, a ceiling, and the like, for example.

The embodiments described above are not limited to the above-described configuration, and may be modified without departing from the scope of the present invention.

The plurality of recessed parts E may individually established with respect to the recessed part height H, the recessed part width W and the recessed part shape, respectively. Representative examples of this are illustrated in FIGS. 12A to 12C.

FIG. 12A illustrates an example in which each of the recessed parts E is formed in a triangular shape. Although the illustrated example related to the arrangement where the recessed part heights H are equal to each other, they may be different from each other, of course. Further, the modified shape of the recessed part E is not limited to a triangular shape, and the shape may be a sine wave shape, for example. In case of the sine wave shape, the sound pressure characteristics in the circumferential direction changes smoothly, so that the change in the sound pressure characteristics in the circumferential direction at the same radial distance from the axis CL91 as the sound emission axis becomes smooth on acoustic feeling. Alternatively, the recessed part E may be formed in a rectangular shape. in this case, it is possible to change the sound pressure characteristics in the circumferential direction sharply.

FIG. 12B illustrates an example in which a plurality of recessed parts E are formed in succession. In this example, a portion where the recessed part height H is 0 (zero) is not a line but a dot in the figure. Of course, the portions may be formed to be partially linear. FIG. 12C illustrates an example in which a plurality of recessed parts E have different recessed part heights H, recessed part widths W and recessed part shapes. Of course, but not all of these characteristics, only some of them may be set to be different. The shapes etc. illustrated in FIGS. 124 to 12C may be combined freely.

Additionally, the front end 9*d* (see FIG. 3 etc.) of the diffuser 9 as the upper end of the diffuser 9 may be formed not to have a flat shape but to have a recessed part that is recessed rearward. Even if the front end 9*d* is provided with a recessed part, the degree of interference between the output sound from the diaphragm 6 and the output sound from the center cap 7 can be adjusted to some extent and therefore, it is possible to suppress a peak or dip on the axis CL51 as the sound emission axis in the sound pressure frequency characteristics of the output sound from the tweeter 91.

By forming the base part 9*b* of the diffuser 9 in the above-described umbrella shape to produce a corner part between the base part and the disc-shaped front end 9*d* thereby defining a space between the diffuser 9 and the center cap 7 having an arc shape, it is possible to reduce a pressure applied to the vibration of the center cap 7 while maintaining an effect of spreading (diffusing) the output sound of the center cap 7. By reason that the vibration is not suppressed since no pressure is applied to the vibration, the output sound from the center cap 7 is emitted forward from the center hole 9*a* with no suppression on the sound pressure of the output sound, thereby allowing the output sound pressure to be increased. In accordance with an output sound quality of the tweeter 91, the shape of the base part 9*b* is not limited to an umbrella, shape that covers the outer circumferential edge side of the center cap 7, and may be a cylindrical shape having the same diameter or a cone shape having a diameter expanding forward, for example.

The number of the support arms 10 connecting the diffuser base 8 with the diffuser 9 and their circumferential positions are not limited to three pieces at a pitch of 120 degrees described above, but may be established according to the specifications, such as a use environment and a sound field to be established. Although the cone shape of the diaphragm 6 of the tweeter 91 has been described as a circular cone shape, it is not limited to a circular shape. It may be elliptical alternatively. In addition, the diffuser 9 is not limited to being mounted on a tweeter for a high frequency range. Even if the diffuser 9 is mounted on a speaker, such as a squawker and a woofer, or a full-range speaker, it is possible to suppress the front room effect and also possible to adjust the directivity characteristics of an output sound.

Although the diaphragm 6 has been described by an example of a diaphragm having a cone shape (including a morning glory petal shape), the shape is not limited to this. As long as one diaphragm as the vibrating body 67 has the annular valley portion Qa to produce the front room effect, it will be applicable as the effect as the diffuser 9 is exhibited.

What is claimed is:

1. A speaker, comprising:

a vibrating body having an annular valley portion recessed rearward; and a diffuser having an annular or arcuate base part, the diffuser being positioned so that an end of the base part on the side of the vibrating body is opposed to the valley portion, wherein the base part is provided, at the end on the side of the vibrating body, with one or more first recessed parts from which distance to the vibrating body is larger than a distance of the other portion of the end to the vibrating body, each of the first recessed parts being formed in any one of a sine-wave shape, a triangular-wave shape and an arc shape.

2. The speaker of claim 1, wherein the base part is provided, at an end thereof in a sound emission direction, with one or more second recessed parts, each of the second recessed parts being formed in any one of a sine-wave shape, a triangular-wave shape and an arc shape.

3. A speaker system, comprising:

a speaker comprising a vibrating body having an annular valley portion recessed rearward, a diffuser having an annular or arcuate base part, the diffuser being positioned so that an end of the base part on the side of the vibrating body is opposed to the valley portion, and the base part provided, at the end on the side of the vibrating body, with one or more first recessed parts from which distance to the vibrating body is larger than a distance of the other portion of the end to the vibrating body, each of the first recessed parts being formed in any one of a sine-wave shape, a triangular-wave shape and an arc shape; and an enclosure on which the speaker is mounted, wherein in a usage posture of the speaker system, one of the first recessed parts is located above an axis of the diffuser.

* * * * *